United States Patent [19]

Schubert

[11] 3,968,566

[45] July 13, 1976

[54] METHOD OF FORMING A DEFLECTION YOKE SYSTEM

[75] Inventor: Rudolf Schubert, Dornstadt, Germany

[73] Assignee: Licentia Patent-Verwaltungs-G.m.b.H., Frankfurt am Main, Germany

[22] Filed: Dec. 19, 1974

[21] Appl. No.: 534,219

Related U.S. Application Data

[60] Division of Ser. No. 444,101, Feb. 20, 1974, abandoned, which is a continuation of Ser. No. 229,343, Feb. 25, 1972, abandoned.

[30] Foreign Application Priority Data

Feb. 27, 1971 Germany ..... 2109439

[52] U.S. Cl. ..... 29/605; 140/92.1; 313/431; 335/213

[51] Int. Cl.[2] ..... H01F 41/06

[58] Field of Search ..... 29/605; 140/92.1, 92.2; 335/210, 213; 313/427–431

[56] References Cited

UNITED STATES PATENTS

| | | | |
|---|---|---|---|
| 1,396,033 | 11/1921 | Francis | 140/92.2 |
| 2,167,379 | 7/1939 | Tolson | 335/213 |
| 3,387,242 | 6/1968 | Corpew | 335/213 |
| 3,445,071 | 5/1969 | Kezer et al. | 242/7.12 |
| 3,676,814 | 7/1972 | Trunzo et al. | 29/605 |
| 3,731,241 | 5/1973 | Coupland | 335/213 |
| 3,855,694 | 12/1974 | Van Der Heijde | 29/605 |

*Primary Examiner*—Carl E. Hall
*Attorney, Agent, or Firm*—Spencer & Kaye

[57] ABSTRACT

The deflection system yoke for a television receiver cathode ray tube includes saddle shaped coils having a plurality of windings arranged in strands along the neck of the tube. The strands are achieved during the winding procedure by introducing starting points for the first winding of each strand. All strands together form a rigid unit.

3 Claims, 5 Drawing Figures

METHOD OF FORMING A DEFLECTION YOKE SYSTEM

CROSS REFERENCE TO RELATED APPLICATION

This application is a division of copending application Ser. No. 444,101, filed Feb. 20th, 1974, now abandoned which itself is a continuation of Ser. No. 229,343, filed Feb. 25th, 1972, now abandoned.

BACKGROUND OF THE INVENTION

The present invention relates generally to television receivers, and more particularly to an improved deflection yoke system for such a receiver.

Present day television receivers generally utilize electromagnetic deflection, and incorporate a deflection yoke which fits over the neck of the cathode ray tube. This yoke contains a plurality of windings and a magnetic core positioned so that when signals are applied to the windings, magnetic fields are created to deflect the electron beam or beams in the cathode ray tube in the desired manner. These signals are applied to the yoke from deflection circuits in the television receiver chassis. The position of every windings and the shape of the coils which include the windings is of great influence to the homogeneity of the magnetic field and hence to the quality of the raster written by the electron beam or beams. Especially with color television receivers the displacement of a single winding about one diameter of the winding will lead to faults of the raster. Such displacement e.g. occurs if temperature increases during the winding procedure of mass production.

SUMMARY OF INVENTION

It is an object of the invention to reduce or to avoid faults in the form of the raster.

Another object is to provide a deflection coil having good performance even with wide deflection angles (e.g. 110°) and multibeam deflection.

It is a further object of this invention to provide a production means and procedure to achieve saddle shaped deflection coils of improved construction.

This is accomplished, according to the above invention, by a saddle shaped deflection coil the longitudinal parts of which are formed in strands of several leads, and by providing a predetermined angle for the start of each strand. In the manufacture of said deflection coils the predetermined angle is achieved by quickly introducing means, e.g. pins, into the winding mandrel.

DESCRIPTION OF THE PREFERRED EMBODIMENTS

Figure 1:
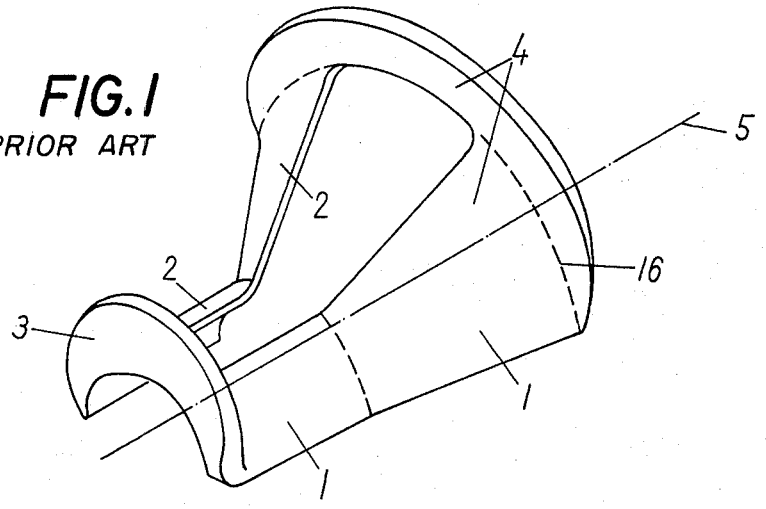
FIG. 1 PRIOR ART
FIG. 1 is a perspective view of a saddle shaped deflection coil (prior art).

Referring now more paricularly to FIG. 1, the coil there is a product of a winding procedure as known in the art. It is one of a pair of identical coils which are assembled in a deflection yoke for establishing one of the deflection fields, for example, the horizontal field within a cathode ray tube. (The other pair of coils for establishing the vertical field may have a similar or indentical construction.) Each saddle shaped coil consists of longitudinal bundles 1 and 2 positioned around axis 5 and interconnected by lobes 3 and 4. Lobe 4 is the larger and shaped to fit the conical section of the tube envelope adjoining the neck section while the remaining lobe 3 is shaped closely to embrace the neck section. The coil is one continuous winding, which may consist of one or more parallel wires.

The said continuous winding is wound to constitute a succession of coils turns of generally similar configuration.

Figure 2:
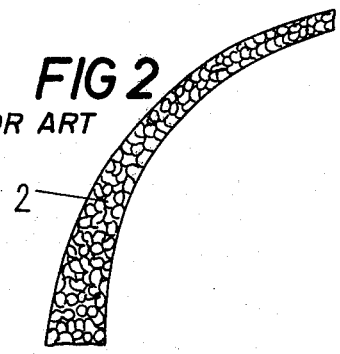
FIG 2 PRIOR ART
FIG. 2 is a cross section of the deflection coil shown in FIG. 1.
Figure 4:
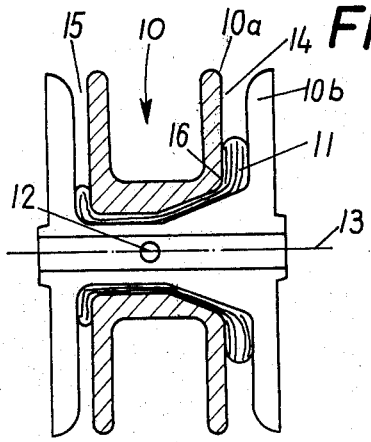
FIG. 4 is a schematic cross-sectional view of a winding mandrel as known for the manufacture of saddle shaped deflection coils.
Figure 5:
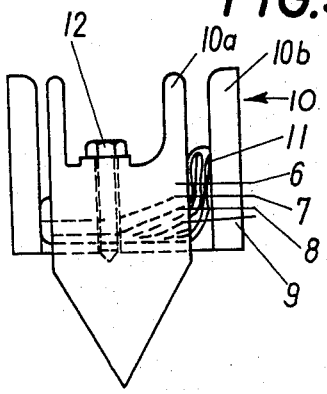
FIG. 5 is another view of the mandrel shown in FIG. 4 and having pins for achieving coils according to the invention.

In FIG. 2 there is shown a cross-sectional view of a longitudinal bundle 2 of the coil shown in FIG. 1. Deflection coils of such configuration are usually wound in mandrels 10 shown in FIG. 4 and FIG. 5 in two different views. Such mandrels 10 consist of at least two portions 10*a* and 10*b* establishing a recess 15 defining a predetermined coil pattern for receiving a continuous wire and for forming the wire into consecutive coil turns having a shape corresponding to the pattern of the recess 15.

The mandrel 10 or a movable guide part (not shown) for feeding the wire into the recess is rotated or moved so that the successive coils turns are laid into said recess. After the required number of coils turns is achieved, the coil is mechanically compressed and, by application of heat, caused to integrate to one selfsustaining structure. By separating the portions 10*a* and 10*b* and loosening screw 12, the coil can be removed from the mandrel for assembling the yoke.

For achieving a homogeneous deflection field the deflection coil should be wound symmetrically. It has been found, however, that deflection coil manufactured by using mandrels as described are unsymmetrical ones. The present invention is based on the recognition that the winding mandrel 10 as presently used suffers in its winding properties as well from temperature and humidity as from variations in the "pull-of-wire" so that it is very difficult to manufacture deflection coils of equal behavior over the whole production series. With variations in the pull of wire it is possible that one longitudinal bundle is wound more loosely than the other bundle so that it will be broader than the other one. There is another disadvantage in tolerances of the diameter of the wire used. A change in the wire's diameter causes changes in the geometrical configuration of the coil because the required width of the recess is dependent on the wire's diameter. Changes in the coils configuration due to the above reasons cause faults in the raster. With color television receivers such faults are usually accompanied by chromatic aberrations. In the prior art variations in the coils configuration have been reduced by mechanically altering the width of the recess. Such procedure cannot overcome, however, changes caused by variations in humidity, temperature and different coatings of the wire.

Figure 3:
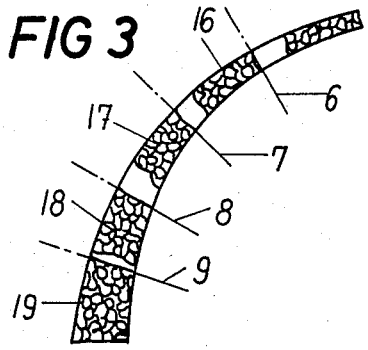
FIG. 3 is a cross section of a saddle shaped deflection coil according to the invention.

In FIG. 3 there is shown a cross sectional view of a longitudinal bundle 2 of a deflection coil according to FIG. 1 when wound in accordance with the invention. The longitudinal bundles are distributed in different strands 16, 17, 18 and 19 being arranged at predetermined areas. This is achieved by providing starting points for each strand at predetermined angles 6, 7, 8, 9. With the manufacture of such coils said starting points are achieved by introducing pins 6, 7, 8, 9 into recesses 14, 15 at the lobes 3 and 4 which pins provide, after winding a predetermined number of turns, a starting point for the following strand. By using this construction according to the invention it is not possible that displacements of one wire can cause displacements of all following wires, too. Pins 6, 7, 8, 9 can be introduced by springs released e.g. by counters. Shooting-in the pins can be achieved mechanically or electrically by relays controlled by counters. Which kind of actuation will be of more advantage is dependent from the type of winding machines. With machines using rotating (axis 13) or movable mandrels electrical actuation will be preferred. In the foregoing description there is used the term strand for a group of coils turns being separated in at least part of the longitudinal bundles. In such a strand there are preferably used wires arranged in parallel.

I claim:

1. A method of winding a saddle shaped deflection coil comprising:

a. providing a mandrel having a recess, whose shape corresponds to the final shape of the coil, for receiving continuously applied coil turns of wire;

b. continuously applying coil turns of wire into said recess to wind the saddle shaped deflection coil;

c. during said step (b), inserting projections at predetermined positions into the recess after applying a predetermined number of coil turns to provide predetermined starting points for the subsequently applied coil turns; and d. heating the completed coil prior to removing same from the mandrel for obtaining a self-sustaining unit.

2. A method according to claim 1 characterized in that the projections are pins.

3. A method according to claim 1 characterized in that the projections are inserted automatically.

* * * * *